US006182724B1

(12) United States Patent
Chou et al.

(10) Patent No.: US 6,182,724 B1
(45) Date of Patent: Feb. 6, 2001

(54) FOLDABLE WORKING BENCH

(76) Inventors: Gin Cherng Chou, No. 11, Nong 7, Lane 92, Nan-Yang Rd., Feng-Yuan City (TW); Wen Chin Chon, No. 11, Nong 7, Lane 92, Nan-Yaun Rd., Feng-Yuan City (TW)

( * ) Notice: Under 35 U.S.C. 154(b), the term of this patent shall be extended for 0 days.

(21) Appl. No.: 09/390,773

(22) Filed: Sep. 7, 1999

(51) Int. Cl.[7] ..... B25H 1/00

(52) U.S. Cl. ..... 144/286.5; 144/286.1; 108/115; 108/127; 108/134; 269/901

(58) Field of Search ..... 108/12, 115, 121, 108/127, 134, 135; 144/1.1, 286.1, 286.5; 248/165, 166, 168, 170, 171, 438, 637, 670, 676, 677, 678; 269/321 CF, 901

(56) References Cited

U.S. PATENT DOCUMENTS 3,070,138 * 12/1962 Baasland ..... 144/286.1
4,362,196 * 12/1982 Ferdinand et al. ..... 144/286.1
4,846,453 * 7/1989 Salotto ..... 144/286.5
5,067,535 * 11/1991 Wolff ..... 144/286.5

* cited by examiner

*Primary Examiner*—W. Donald Bray
(74) *Attorney, Agent, or Firm*—Charles E. Baxley

(57) ABSTRACT

A foldable working bench includes two side frames each including two posts and a collapsible device connected between the two posts. An upper deck is connected on the top of the two side frames and a lower deck is connected between the two side frames and located below the upper deck. The upper deck is able to be slid to the same side of the two side frames when the two side frames are collapsed. A board is fixedly connected to the other side of the two side frames and the lower deck is pivotally connected to the board when the two side frames are collapsed. A roof unit is removably connected to the top of the two side frames.

8 Claims, 3 Drawing Sheets

FOLDABLE WORKING BENCH

FIELD OF THE INVENTION

The present invention relates to a working bench, and more particularly, to a foldable working bench having a top deck and a second deck connected between two foldable side frames. A roof unit is connected to the top of the two side frames so that the users may assemble the working bench within a short period of time.

BACKGROUND OF THE INVENTION

When workers begin a new work, in order to have a suitable working bench to set up the bench saw or the like, the workers usually build a temporary working bench by boards connected by nails or staples in the inside of the house where the job is to be proceeded. The working bench is very simple and it will be disassembled and discarded after the job is over. Generally, the width of the working bench is wider than that of the door of the house so that it is impossible to move the bench from the door to another place where another job is proceeded. That is part of the reasons that the workers discard the working bench and build a new working bench. Every time the workers build a new working bench, they have to prepare a lot of boards and carry the boards to the place where the job is to be proceeded.

The present invention intends to provide a foldable working bench comprising two foldable side frames with a top deck and a second deck connected between the two side frames. The top deck has a drawer unit connected to a bottom thereof. A roof unit is removably connected to the two side frames so that the working bench can be used outside.

The working bench of the present invention is convenient for the users and easily to be carried and transported so that the users do not need to build new working benches anymore.

SUMMARY OF THE INVENTION

In accordance with one aspect of the present invention, a foldable working bench is provided and comprises two side frames each having two posts and a collapsible device connected between the two posts. One of the two posts of each side frame has a flange extending therefrom and a support member is connected between the two flanges of the two side frames. A board is fixedly connected between two respective posts on the same side of the two side frames, and a lower deck is pivotally connected to a lower side of the first board. An upper deck is pivotally and movably connected between two respective post on the same side of the two side frames so that the upper deck is movably supported on the four posts of the two side frames.

The main object of the present invention is to provide a working bench which is folded to become a compact size so as to be conveniently carried.

Further objects, advantages, and features of the present invention will become apparent from the following detailed description with appropriate reference to the accompanying drawings.

DETAILED DESCRIPTION OF THE PREFERRED EMBODIMENTS

Figure 1:
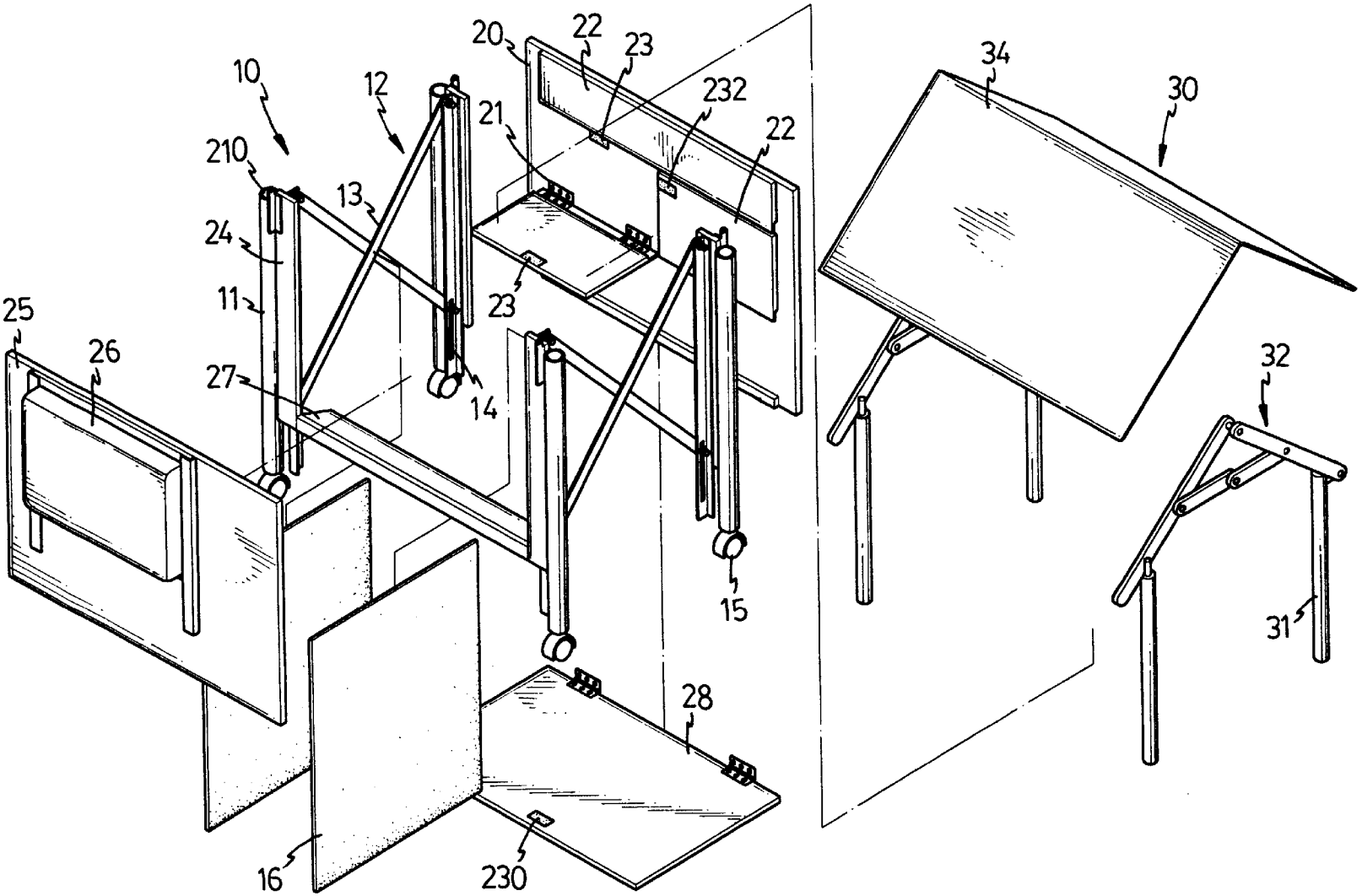
FIG. 1 is an exploded view of the working bench in accordance with the present invention.
Figure 2:
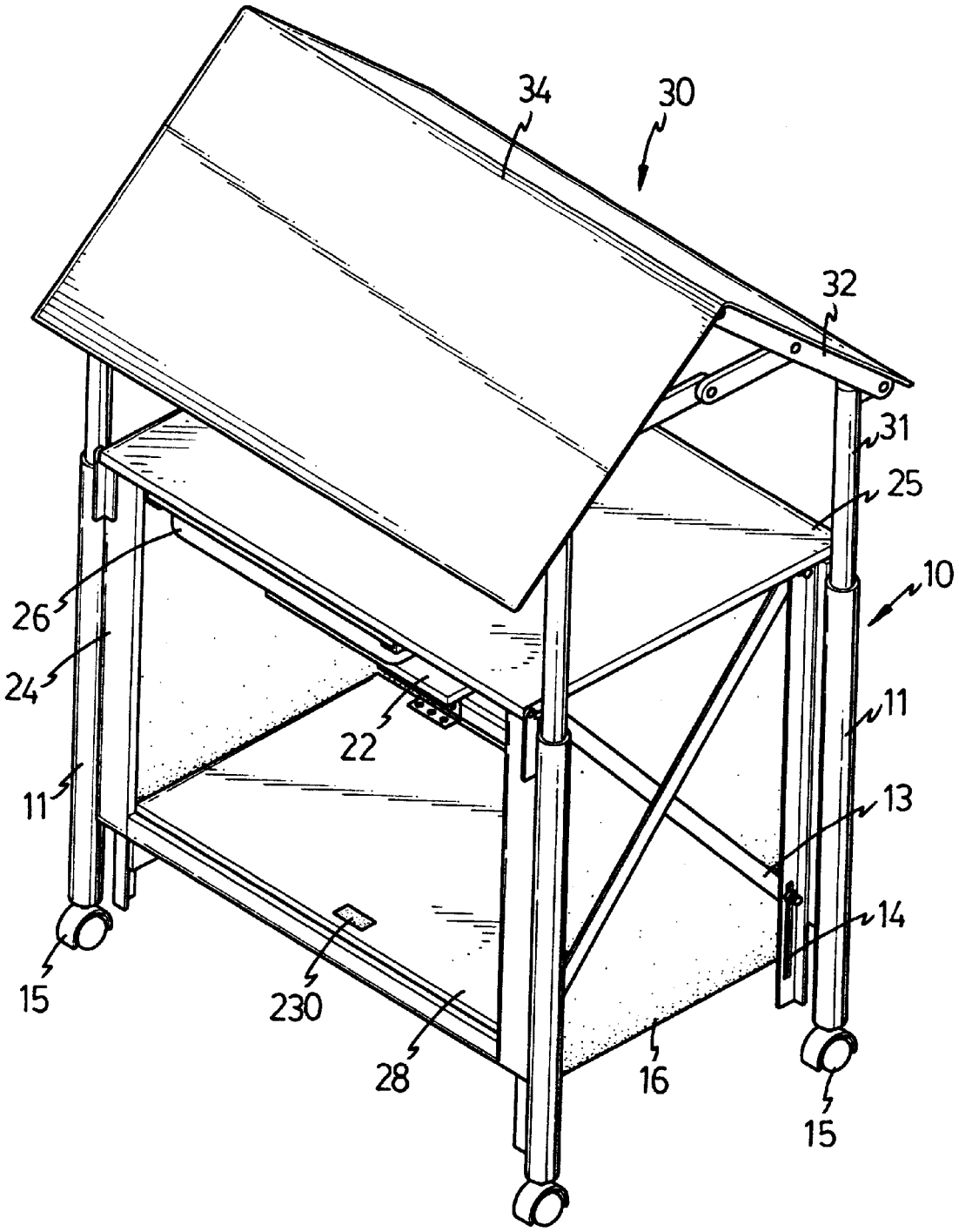
FIG. 2 is a perspective view of the working bench in accordance with the present invention.
Figure 3:
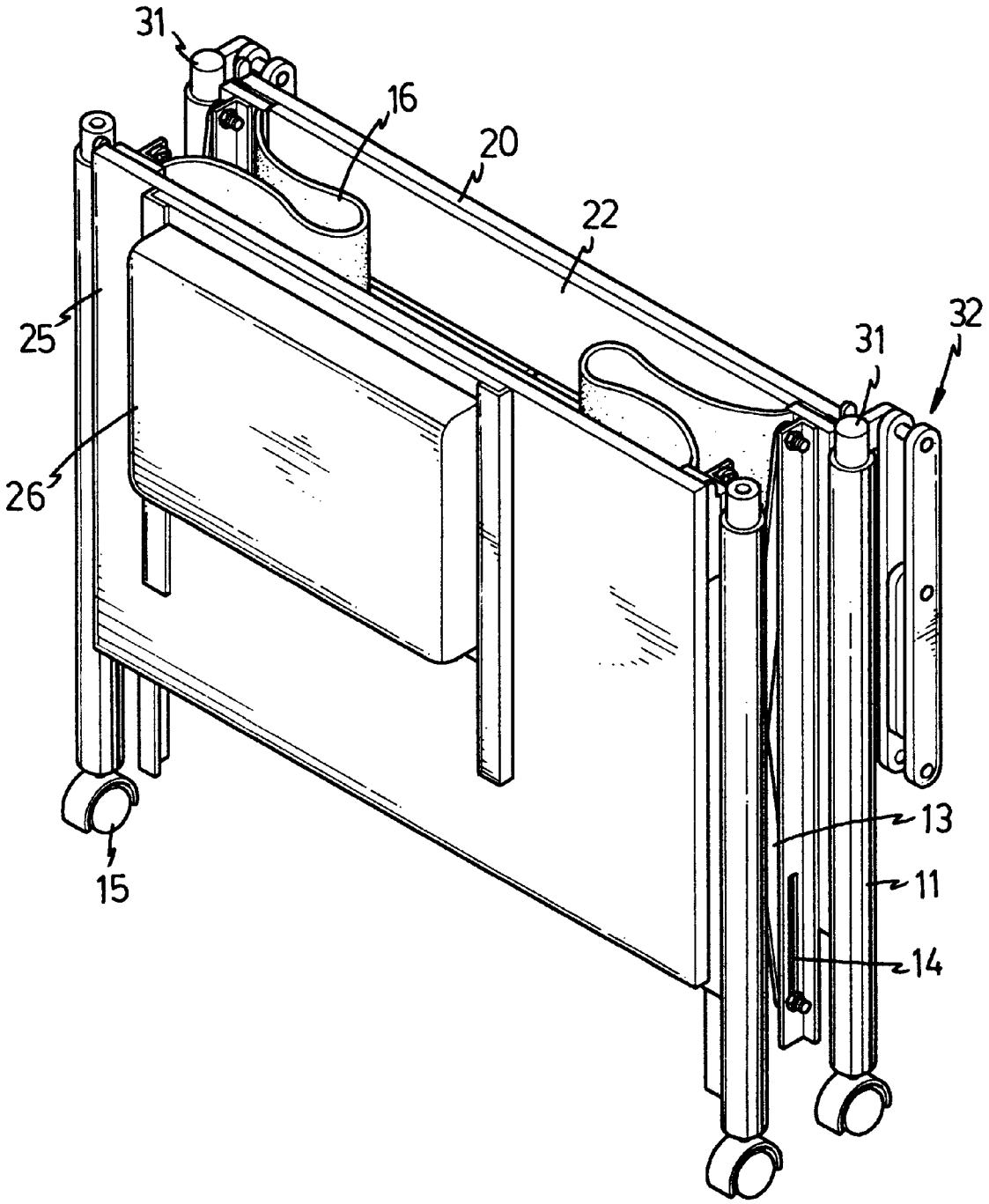
FIG. 3 is a perspective view of the working bench in accordance with the present invention, wherein the working bench is in a folded status.

Referring to FIGS. 1 to 3, the working bench of the present invention comprises two side frames 10 each having two posts 11 and a collapsible device 12 connected between the two posts 11. Each post 11 of the two side frames 10 has a groove 14 defined therein so that one of two links 13 composing the collapsible device 12 is slidably engaged with the groove 14. Therefore, the two posts 11 of the side frame 10 can be pulled together by collapsing the two links 13 as shown in FIG. 3. One of the two posts 11 of each side frame 10 has a flange 24 extending therefrom and a support member 27 is connected between the two flanges 24 of the two side frames 10. Each flange 24 has a connecting member 210 connected thereto. Each post 11 of each side frame 10 has an open top. The roof unit 30 includes two sets of foldable links 32 and a roof 34 connected between the two sets of foldable links 32. Each set of foldable links 32 has two supporting rods 31 which are inserted into the open top of the four posts 11.

Each post 11 has a wheel 15 connected to a lower end thereof so that the working bench is easily moved. A sheet of fabric 16 is connected between the two posts 11 of each side frame 10 so that the two ends of the working bench have two closed ends.

A board 20 is fixedly connected between two respective posts 11 on the same side of the two side frames 10. The board 20 has three auxiliary boards 22, which are pivotally connected to one of two surfaces thereof by pivot members 21. Each of the auxiliary boards 22 can be attached to the board 20 by using Velcro straps 23 as shown. A lower deck 28 is pivotally connected to a lower side of the board 20 and the lower deck 28 can be supported on the support member 27, or adhered to the board 20 by the connecting member such as a Velcro straps 230 which is engaged with a connecting member 232 on the other side of the auxiliary board 22.

An upper deck 25 is pivotally and movably connected between the two connecting members 210 and the upper deck 25 is movably supported on the four posts 11 of the two side frames 10. In other words, the upper deck 25 has two positions, one of which is on the same side of the two side frames 10 and the other position is connected across the two side frames 10. A drawer unit 26 is connected to the upper deck 25 so that when the upper deck 25 is shifted between the two side frames 10, the drawer unit 26 can be used to receive tools or screws.

The working bench of the present invention can be disassembled into small parts so that they can be easily carried to the working places. The working bench allows the users not to find material to build a new bench every time they start to a job.

The invention is not limited to the above embodiment but various modification thereof may be made. It will be understood by those skilled in the art that various changes in form and detail may made without departing from the scope and spirit of the present invention.

What is claimed is:

1. A foldable working bench comprising:

two side frames each having two posts and a collapsible device connected between said two posts, one of said two posts of each side frame having a flange extending therefrom and a support member connected between said two flanges of said two side frames, each flange having a connecting member connected thereto;

a board fixedly connected between two respective posts on the same side of said two side frames;

a lower deck pivotally connected to a lower side of said first board, and an upper deck pivotally and movably connected between said two connecting members and said upper deck movably supported on said four posts of said two side frames.

2. The working bench as claimed in claim 1 further comprising a drawer unit connected to said upper deck.

3. The working bench as claimed in claim 1 further comprising a roof unit connected between said two side frames.

4. The working bench as claimed in claim 1, wherein each post of each side frame has an open top and said roof unit includes four supporting rods which are inserted into the open top of said four posts.

5. The working bench as claimed in claim 1, wherein each post has a wheel connected to a lower end thereof.

6. The working bench as claimed in claim 1, wherein said board has a connecting member connected thereto and said lower deck has another connecting member connected thereto, said connecting member on said lower deck connected to said connecting member on said board when said lower deck is pivoted toward said board.

7. The working bench as claimed in claim 1, wherein each post of said two side frames has a groove defined therein so that said collapsible device is slidably engaged with said groove.

8. The working bench as claimed in claim 1 further comprising a sheet of fabric connected between said two posts of each side frame.

* * * * *